US007901860B2

(12) United States Patent
Deprez et al.

(10) Patent No.: US 7,901,860 B2
(45) Date of Patent: Mar. 8, 2011

(54) ROUNDED RADIATION CURABLE TONER

(75) Inventors: Lode Deprez, Wachtebeke (BE); Werner Op De Beeck, Putte (BE)

(73) Assignee: Xeikon IP BV, Eede (NL)

( * ) Notice: Subject to any disclaimer, the term of this patent is extended or adjusted under 35 U.S.C. 154(b) by 556 days.

(21) Appl. No.: 12/000,037

(22) Filed: Dec. 7, 2007

(65) Prior Publication Data

US 2008/0176160 A1 Jul. 24, 2008

(30) Foreign Application Priority Data

Dec. 7, 2006 (EP) ..... 06025300

(51) Int. Cl.
*G03G 9/00* (2006.01)

(52) U.S. Cl. ..... 430/109.31; 430/109.1; 430/110.3; 430/137.15; 399/252; 399/320

(58) Field of Classification Search ..... 430/109.31, 430/137.15, 110.3, 109.1; 399/320, 252
See application file for complete search history.

(56) References Cited

U.S. PATENT DOCUMENTS

| | | | | |
|---|---|---|---|---|
| 3,944,493 | A | 3/1976 | Jadwin et al. | |
| 4,007,293 | A | 2/1977 | Mincer et al. | |
| 4,079,014 | A | 3/1978 | Burness et al. | |
| 4,298,672 | A | 11/1981 | Lu | |
| 4,394,430 | A | 7/1983 | Jadwin et al. | |
| 4,464,452 | A | 8/1984 | Gruber et al. | |
| 4,480,021 | A | 10/1984 | Lu et al. | |
| 4,560,635 | A | 12/1985 | Hoffend et al. | |
| 4,656,112 | A | 4/1987 | Kawagishi et al. | |
| 4,845,003 | A | 7/1989 | Kiriu et al. | |
| 4,937,157 | A | 6/1990 | Haack et al. | |
| 5,212,526 | A | 5/1993 | Domoto et al. | |
| 5,905,012 | A | 5/1999 | De Meutter et al. | |
| 6,358,658 | B1 | 3/2002 | Tazawa et al. | |
| 6,461,782 | B1 | 10/2002 | Sasada et al. | |
| 6,635,398 | B1 | 10/2003 | Komoto et al. | |
| 6,887,640 | B2 * | 5/2005 | Zhang et al. | 430/124.4 |
| 2005/0137278 | A1 | 6/2005 | Fromm et al. | |

FOREIGN PATENT DOCUMENTS

| | | | |
|---|---|---|---|
| EP | 0 601 235 | B1 | 6/1994 |
| EP | 0 667 381 | A2 | 8/1995 |
| EP | 1 096 324 | A1 | 5/2001 |

(Continued)

OTHER PUBLICATIONS

Search Report of European Patent Office Concerning EP 0 6025300.2 (May 21, 2007).

(Continued)

*Primary Examiner* — Mark A Chapman
(74) *Attorney, Agent, or Firm* — Bacon & Thomas PLLC

(57) ABSTRACT

The present invention provides dry toner particles comprising at least a radiation curable resin, and a colouring agent, wherein the circularity of the toner particles is between 0.95 and 0.99 and a charge control agent in a concentration between 0.025% and 1.0% by weight is present preferably as an external additive.
The toners of this invention are useful for printing any substrate and for use in any form of printing or marking device.

16 Claims, 2 Drawing Sheets

FOREIGN PATENT DOCUMENTS

| | | | |
|---|---|---|---|
| EP | 1 186 961 | A1 | 3/2002 |
| EP | 1 288 724 | A2 | 3/2003 |
| EP | 1 341 048 | A1 | 9/2003 |
| EP | 1 437 628 | A1 | 7/2004 |
| EP | 1 610 186 | A2 | 12/2005 |
| EP | 0 792 325 | B2 | 4/2007 |
| WO | WO 2005/116778 | A1 | 12/2005 |

OTHER PUBLICATIONS

Nash, Robert et al. "CCA Effects on the Triboelectric Charging Properties of a Two-Component Xerographic Developer" *J. Imaging Science and Technology*, 46:313-320 (2002).

Communication from European Patent Office regarding European Patent Application No. 06025300.2, dated Feb. 19, 2009.

* cited by examiner

ROUNDED RADIATION CURABLE TONER

The present invention relates to improved radiation curable toner compositions, in particular UV-curable toner particles, as well as to improved dry developer compositions. The present invention also relates to a more efficient method of fusing and curing dry toner particles, and to marking devices such as printers using such toner compositions and dry developer compositions as well as to substrates printed with a toner comprising said improved radiation curable toner compositions.

BACKGROUND OF THE INVENTION

In imaging methods like electro(photo)graphy, magnetography, ionography, etc. a latent image is formed which is developed by attraction of so called toner particles. Afterwards the developed latent image (toner image) is transferred to a final substrate and fused to this substrate. In direct electrostatic printing (DEP) printing is performed directly from a toner delivery means on a receiving substrate by means of an electronically addressable print head structure.

Toner particles are basically polymeric particles comprising a polymeric resin as a main component and various ingredients mixed with said toner resin. Apart from colourless toners, which are used e.g. for a finishing function, the toner particles comprise at least one black and/or colouring substances, e.g., coloured pigment.

In the beginning colour electro(photo)graphy was mostly used for producing coloured images (e.g. graphic arts, presentations, coloured books, dissertations, . . . ). When the process speed of producing digital coloured images increases, other more productive applications also came into the picture (direct mailing, transactional printing, packaging, label printing, security printing, . . . ). This means that after the action of being produced by electro(photo)graphy, the toner images further have to withstand some external factors applied during the subsequent treatments such as mechanical treatments, solvent treatments and temperature treatments. The problems associated with multiple, superimposed layers of toner particles that are in one way or another fixed on a substrate are manifold, not only with respect to image quality but also with respect to image stability and with respect to mechanical stability issues.

All the above requirements can be solved by using a radiation curable toner.

The use of a transparent cover coat made out of radiation curable toner particles has been described already in e.g. U.S. Pat. No. 5,905,012 to protect an image produced by electrophotography and thereby to improve the weather resistance of an image produced by means of electrophotography.

A non image wise transparent UV curable coating has been described already in EP-A-1,288,724 to give a flexible, high gloss finishing to printed papers. Prints obtained by means of electrophotography and by the use of thermally fixable toner are thermally stable only to approximately 100° C. Packaging materials may however have to be partly heated to temperatures far above 100° C., e.g. during the production of sealed packaging. Thus for example for sealable packaging, a completely transparent, heat resistant coat layer from a toner hardening by UV light has been described in EP 1,186,961.

In EP 1,341,048 a process is described for crosslinking an unsaturated polyester under UV light.

In U.S. Pat. No. 6,461,782 a UV curable toner is described based on a cationic UV curable polymer in order to improve the mechanical resistance of the image when fusing at low temperatures.

The use of UV curable pigmented powders is already well known in the field of powder coatings (e.g. EP 792,325), but there are some major differences with respect to printer toners. The size of the particles (6-10 microns for toner versus >30 microns for powder coatings) and the particle size distribution are quite different. Also the thickness of the layers applied with powder coatings is at least a factor 3 to 4 times thicker in comparison with the printed toner images. The speed of fusing and curing is very low compared to the high speed printers which are now available in the field (e.g. Igen3, Xeikon 5000, . . . ). Powder coatings are also never applied image wise. The powders are charged by some means and brought onto the surface of the material, which has to be coated. This is all quite different from toner, which is brought either directly image wise on a substrate, or via a latent image on a photoconductor to a substrate.

In U.S. Pat. No. 5,212,526 an UV curable liquid toner has been described to improve the adhesion of the cured toner to the final substrate rather than to the surface of the image receptor during the transfuse step instead of withstanding to high temperatures. The curing here takes place during the transfer step from photoreceptor to paper.

In U.S. Patent Application Publication No. 2005/0137278 a general description is found of an emulsion aggregation (EA) toner based on styrene and an acrylate which contains also UV curable oligomers. After UV irradiation the UV curable oligomers start to crosslink and will react with the unsaturated groups of the EA monomers.

In EP 1,610,186 a process is described where toners prepared by emulsion aggregation are cured by electron beam (EB) curing. The toner contains at least a vinyl monomer and at least one EB curable polymer, and optionally a charge control additive.

In WO2005/116778 a very specific toner composition is described to be able to obtain a broad curing window independent of the colours and toner layer thickness, the particles of said toner composition comprising at least a colouring agent and a blend of radiation curable resins comprising (a) a (meth)acrylated epoxy/polyester resin and (b) a (meth)acrylated polyurethane resin, and optionally a positive or negative charge control agent. The circularity of these toner particles, and the amount of charge control agent optionally present, are not disclosed.

EP 1,096,324 describes toner particles containing at least a binder resin, a colorant, a wax component, and an external additive, wherein:

(1) the binder resin contains a component derived from butadiene, isoprene or chloroprene;
(2) said toner has a main glass transition temperature (Tg) from 40° C. to 70° C. as measured by differential scanning calorimetry (DSC);
(3) the toner satisfies a specific relationship between its specific surface area (BET method) at 23° C. and 65% relative humidity and its specific surface area (BET method) at 50° C. and 3% relative humidity;
(4) as measured with a flow type particle image analyser, the toner particles have an average diameter from 2 to 10 μm, an average circularity from 0.950 to 0.995 and a circularity standard deviation less than 0.04; and
(5) as measured by gel permeation chromatography (GPC), the toner has a main-peak molecular weight from 2,000 to 100,000 and contains from 5% to 60% by weight THF-insoluble matter.

The external additive present in the toner particles of EP 1,096,324 may an inorganic fine powder (such as silica, titanium or alumina) optionally treated with a silicone, or it may include a lubricant, an abrasive, an anti-caking agent, a conductivity-providing agent, or a developing performance improver such as white or black fine powder with a polarity reverse to that of toner particles. The toner of EP 1,096,324 may also optionally comprise a charge control agent in an amount from 0.1% to 10% by weight of the binder resin.

The circularity feature of the toner particles of EP 1,096,324 is described as a combination with the other features of said toner, in particular the chemical nature of the monomer(s) present as component(s) of the binder resin. EP 1,096,324 teaches that since diene monomers include no oxygen atom, there is no site which may absorb water in air, so that any leak of electric charges may hardly occur in the toner. Moreover since diene monomers have two radically polymerizable double bonds and can easily have a three-dimensional structure, they can contribute to increasing viscosity and formation of a network structure, therefore improving the distribution of pigments dispersed in the toner particles, and improving tints of toners better than monomers such as styrene, vinylcyclohexane, or divinylbenzene. As a consequence, a diene monomer is an essential component of the binder resin of EP 1,096,324. However it should be noticed that EP 1,096,324 fails to mention any type of curing or submitting the toner composition to any type of radiation.

In the Journal of Imaging Science and Technology (2002) 46:313-320 an academic study by Nash et al. is presented on the charging properties of toners and carriers. A comparison in made between toners with internal mixed charging agents and external mixed charging agents in their charging behaviour on a CCA (Charge Control Agent) and non-CCA coated carrier. This study teaches that the place where the CCA is located (e.g. inside toner, outside toner, on the carrier surface) determines very much the charging performance and also charging value (positive or negative) and that a lot of care is needed when CCA's are mounted. No guidance is given on the effect of CCA's inside toner systems on properties of the toner or toner image. This reference does not teach the circularity of the toner particles tested, or the nature of the resin matrix present in the toner particles tested.

In a lot of the above applications where UV curable can be used a very wide range of substrates are used, e.g. paper, foils and laminates with various thicknesses. It is not obvious to obtain and realize a good transfer efficiency and an acceptable print quality on the different substrates, which have all their specific electrical and surface properties.

By the fact that the printing speed of the current digital presses is increasing and can be adjusted according to the application and or type of substrate, more and higher demands with respect to toner developabilty and chargebiltiy are required. Also the fact that in digital colour printing the page content can be different for each colour and from job to job, places higher demands for developabilty and chargebiltiy on the toner.

From all those references only a general description of radiation curable toner is found and a high quality performing radiation curable toner is still not attainable with the above teachings. In particular it is known to the skilled person that the charge stability and charge build up of rounded toner particles with a circularity of at least 0.95 is significantly worse than that of non-rounded toners. Therefore there is still a need in the art, which is one problem addressed by the present invention, for dry toner particles exhibiting both a circularity of at least 0.95 and a suitable combination of charge stability and charge build up for high performance printing.

SUMMARY OF THE INVENTION

There is a need in the art for radiation curable toner particles which provide a significantly improved transfer efficiency lower fuser temperature, and/or a better print quality, and/or better charge characteristics and/or extended developer lifetime.

It is an object of the present invention to provide a toner with a high transfer efficiency under different printing conditions in terms of speed, substrates and toner throughput, as well as a printer using such a toner and a substrate printed with such a toner.

It is an advantage of embodiments of the present invention to provide a toner with improved image quality (hollow characters, noise and edge effects) under different printing conditions in terms of speed, substrates and toner throughput.

It is a further advantage of embodiments of the present invention to provide a toner with good electro-photographical properties like developability and chargeability under different printing conditions in terms of speed, substrates and toner throughput.

It is a further advantage of embodiments of the present invention to provide a toner with an extended developer lifetime.

The present invention provides dry toner particles comprising at least a radiation curable resin and a colouring agent, wherein said dry toner particles comprise at least one charge control agent in an amount from about 0.025% to about 1.0% (preferably between 0.025 and 0.5%) by weight, and wherein the circularity of the toner particles is between 0.95-0.99. Preferably the dry toner particles according to this invention comprise at least a radiation curable polyester resin. The term "comprise at least a radiation curable polyester resin" allows the presence of additional binder polymers and/or additional radiation curable binder resins in addition to the recited radiation curable polyester resin.

In one embodiment of the present invention, the dry toner particles may comprise the at least one charge controlling agent at the surface of the toner particles.

In one embodiment of the present invention, the dry toner particles may comprise at least one surface additive with a particle size >20 nm.

The viscosity of the toner particles according to one embodiment of this invention can be between 50 and 5,000 Pa·s at 120° C., for example.

The radiation curable resin present in the toner particles according to this invention may comprise, for example, a blend of (a) a (meth)acryloyl containing polyester, and (b) a polyester-urethane (meth)acrylate resin.

The blend ratio (a)/(b) is not critical, as far as a suitable miscibility or a suitable homogeneous blend can preferably be achieved, and can vary for example between about 92.5/7.5 and about 50/50 by weight.

The present invention also provides a dry electrostatographic developer composition comprising carrier particles and toner particles as described in any of the above embodiments.

The dry electrostatographic developer composition can be such that:

- said carrier particles have a volume average particle size of between about 30 μm to about 65 μm, and/or
- said carrier particles comprise a core particle coated with a resin in an amount of about 0.4% to about 2.5% by weight, and/or
- the absolute charge expressed as fC/10 μm (q/d) is between about 3 and about 15 fC/10 μm.

The present invention also includes a method of fusing and curing dry toner particles a described in any of the above embodiments, whereby said toner particles are image wise deposited on a substrate, said toner particles are then fused onto said substrate, and finally, the fused toner particles are cured by means of radiation.

The radiation used for curing can be UV light, or any other radiation suitable for curing the resin included in the toner particles. The toner particles may comprise one or more photoinitiators to assist in the curing process, e.g. the UV curing process.

As an example of the present invention this method can be carried with the fusing and the curing done in-line or off-line.

The present invention includes an apparatus for forming a toner on a substrate comprising:

i) means for supplying dry toner particles, ii) means for image-wise depositing said dry toner particles on said substrate, iii) means for fusing said toner particles on said substrate, and iv) means for off-line or in-line radiation curing said fused toner particles, wherein said dry toner particles are as described in any of the above embodiments.

The substrate to be marked or printed can be fed as a sheet material or as a web.

The present invention also includes a substrate printed or marked with the toner as described in any of the above embodiments.

Further objects and advantages of the present invention will become evident from the detailed description hereinafter.

DETAILED DESCRIPTION OF THE INVENTION

Figure 1:
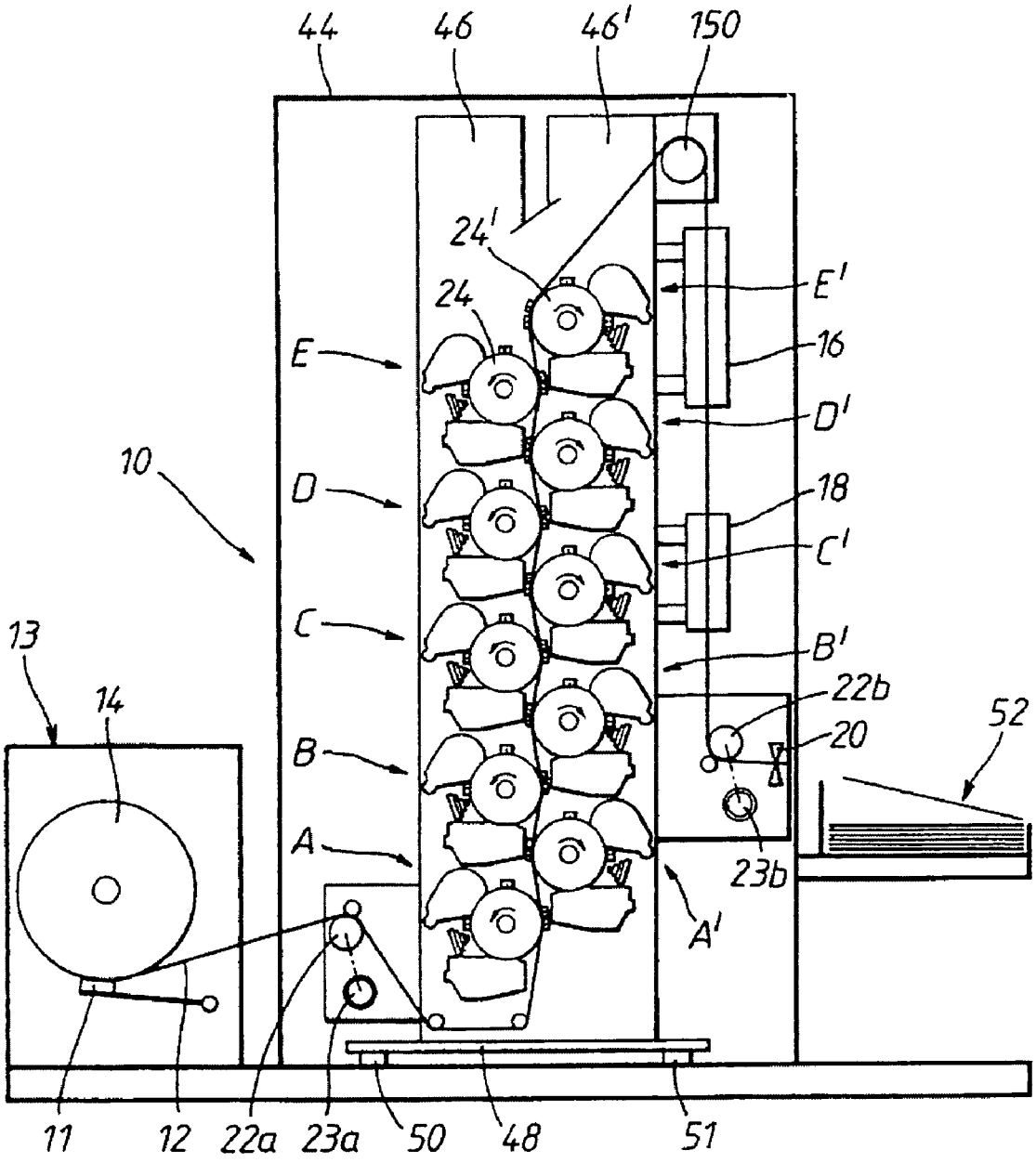
FIG. 1 shows an example of a printer with which toners according to the present invention may be used.

The present invention relates to improved radiation curable toner compositions, in particular UV-curable toner particles, as well as to improved dry developer compositions. The present invention also relates to a more efficient method of fusing and curing dry toner particles, and to substrates printed with a toner comprising said improved radiation curable toner compositions. The present invention also relates to marking devices such as printers including such toner or developing compositions. The embodiments are provided as examples of the invention but are not necessarily limiting. The term radiation curing includes any method of curing printed using electromagnetic radiation such as UV light, or electro-beam curing.

To obtain a good curing efficiency the toner has to be brought in a low viscous state so that the mobility of the reactive groups (e.g. double bounds) is high and the right degree of crosslinking can be achieved. This means that the glass transition temperature ($T_g$) should not be too high and that the viscosity of the toner, e.g. the UV toner, should also be as low as possible. Using low $T_g$ and low viscosity toners has however some major drawbacks.

A first drawback is that the use of a low $T_g$ resin binder in the toner composition causes limitations with respect to toner storage conditions and an increased risk for the formation of toner aggregates or lumps in the developing unit during the toner carrier mixing. Therefore the toners should preferably have a $T_g$>35° C. and more preferably >40° C.

A second drawback is that during the mixing of toner and carrier in the developing unit the surface additives used to control the charge and toner flow characteristics will be embedded. This change in toner surface state changes the charging and flowing properties of the toner, meaning that no stable charge over time and/or under different page coverage can be established. Another effect of embedded surface additives is that the developing ability decreases by a stronger interaction between toner and carrier so that the adhesion forces increase and it is more difficult to develop the toner onto the photoconductor for the same development potential. Those problems can be overcome by applying high amounts of surface additives on the toner surface. This however will reduce the ability to fuse and as a consequence cure the toner in a proper way. Another disadvantage of high concentration of surface additives is that the toner is more sensitive to environmental conditions and also the charge dependence on different toner throughputs will be higher. The toner throughput depends on the process speed and the page coverage. The page coverage is the actual amount of toner applied to the substrate compared with a 100% coverage of the substrate. For actual digital printing engines, like the Xeikon 5000 model, this means that the toner throughput can vary between 0 mg/s and 600 mg/s. A toner throughput of 0 mg/s correspond to a situation where that specific colour is not printed and 600 mg/s correspond to a situation where the substrate is 100% covered with toner at printing speeds of 16 cm/s. This large difference in toner throughput requires very stable charge characteristics in order to obtain a good and stable print quality over time.

Another problem encountered when the toner surface gets embedded with external additives is that the transfer from the photoconductor to the substrate becomes more critical due to the increased adhesion forces. This is even more pronounced with thick substrates and/or smooth surface substrates. A less efficient toner transfer will not only result in a lower transfer yield but also in a lower image quality with respect to image noise, hollow characters and edge and transition effects. For some sensitive substrates it is even not possible to realize a good transfer even if the surface additives are not yet embedded. The image artefact known as "hollow characters" can be described as an incomplete transfer of a second colour on top of a first colour specifically in line work. As a result in a red (yellow+magenta) image for example the colour will be more yellowish due to the inadequate transfer of the magenta toner.

Faced with the large number of partly contradictory influencing factors (as indicated above) it is not obvious how to improve a toner for use in a modern digital printer. It has now been surprisingly found that by rounding the toner particles above a certain level, and choosing the right concentration of charge control additives, a radiation curable (especially a UV curable) toner can be produced that is characterized by a high transfer efficiency and a high printing quality. Without being limited by theory, an explanation can be found in the fact that the number of contact points is reduced and thus the impact surface between carrier and toner in the developing unit and also between toner, photoconductor and substrate in the transfer step. By the impact reduction the surface additives, e.g. the charge control agent, remains at the surface and possibly do not get embedded in the particles.

The rounding of the toner can be expressed by the circularity of the toner particles and in this invention the circularity is between 0.95 and 0.99, preferably between 0.96 and 0.985 and even more preferably between 0.965 and 0980. When the circularity is lower than 0.950, embedding of surface additives is likely to occur, the transfer efficiency will be lower and the image quality is also lower. When the circularity is higher than 0.99 the toner particles are too round. This will result in a toner with a very high transfer efficiency but the charge stability and charge built up may be less good or even very bad. Due to the high mobility of the toner the charge at the start of the activation will be low and will gradually increase during activation. This will cause an unstable development process resulting in some circumstances in too low density prints because of too high charge after printing pages with low toner throughput and in some cases in background noise when the charge is too low because the developer could not build quick enough charge by the for example a too high toner throughput. Another problem with particles that are too circular is the fact that the coalescence of the toner particles during fusing is made more difficult resulting in a lower degree of curing In general the charge stability and charge build up of rounded radiation curable toners with a circularity of 0.95 to 0.99 is worse than non-rounded radiation curable toners. This drawback is overcome according to the present invention by using at least one charge controlling agent in appropriate concentrations with respect to the radiation curable resin.

Positive and negative charge control agents can be used to adjust the triboelectric charge ability in either negative or positive direction. Very useful charge control agents for providing a net positive charge to the toner particles are, for example, nigrosine salts (more particularly Bontron N04, trade name of Orient Chemical Industries—Japan) and quaternary ammonium salts. Charge control agents for yielding negative chargeable toners are, for example, metal complexes of salicylate (e.g. Bontron E84 or E88 from Orient Chemical Industries and Spilon Black TRH from Hodogaya Chemicals), and organic salts of an inorganic polyanion (Copycharge N4P, a trade name from Clariant). Preferably are the metal complexes of salicylate like Bontron E84 and Bontron E88 especially for colour applications because they are colourless. Other suitable charge control additives include, but are not limited to:

- alkyl pyridinium halides such as cetyl pyridinium chloride and others disclosed in U.S. Pat. No. 4,298,672, the disclosure of which is hereby incorporated by reference;
- sulfates and bisulfates, including distearyidimethylammonium methyl sulfate as disclosed in U.S. Pat. No. 4,560,635, the disclosure of which is hereby incorporated by reference, and distearyldimethylammonium bisulfate as disclosed in U.S. Pat. No. 4,937,157 and U.S. Pat. No. 4,560,635, the disclosures of which are hereby incorporated by reference;
- zinc 3,5-di-tert-butyl salicylate compounds, zinc benzoate compounds, and other zinc compounds as disclosed in U.S. Pat. No. 4,656,112, the disclosure of which is hereby incorporated by reference;
- aluminium 3,5-di-tert-butyl salicylate compounds and other aluminium compounds as disclosed in U.S. Pat. No. 4,845,003, the disclosure of which is hereby incorporated by reference; and
- charge control additives as disclosed in U.S. Pat. No. 3,944,493; U.S. Pat. No. 4,007,293; U.S. Pat. No. 4,079,014; U.S. Pat. No. 4,394,430; U.S. Pat. No. 4,464,452; U.S. Pat. No. 4,480,021 and U.S. Pat. No. 4,560,635, the disclosures of which are hereby incorporated by reference;

as well as mixtures thereof in any suitable proportions.

A description of charge control agents, pigments and other additives useful in toner particles, to be used in a toner composition according to the present invention, can be found in e.g. EP-601,235-B1.

However, some limitations have been noticed in the use of charge controlling agents, particularly when used in UV curable toners, and more especially in the presence of a photoinitiator. When the concentration of these charge controlling agents with respect to the radiation curable resin becomes too high, one can obtain good charging characteristics but on the other hand the curing efficiency can become worse and result in a decreased print quality over time. This can probably be explained by the fact that the charge controlling agents capture some of the formed radicals of the photoinitiator and thus lower the curing degree. The best curing results can be found when the total concentration of charge controlling agents is below about 1.0% by weight preferably lower then about 0.5% by weight and even more preferably lower then about 0.3% by weight. For instance, the total concentration of charge controlling agents may be below about 0.2% by weight, or below 0.1% by weight. After extensive investigations, it has been found that the best results can be obtained, as well as for curing as for charging characteristics, when the charge controlling agents are added as external surface additives. Because they are present at the surface of the toner particle, the efficiency of these charge controlling agents is much more pronounced, compared with using them in the bulk in the same concentration. Good results are obtained when the concentration of these charge controlling agents (e.g. when used as an external additive) is above about 0.025% by weight, e.g. between 0.025% and 0.5% by weight, more preferably between about 0.03% by weight and about 0.25% by weight, even more preferably between about 0.05% by weight and about 0.2% by weight. When the concentration of charge controlling agents is below 0.025% by weight, their effect on charging characteristics is usually too small but when, on the other hand the concentration of charge controlling agents is higher than about 0.5% by weight, the resulting charge may become too high and/or unstable under different printing conditions. The presence of charge controlling agents has also a positive effect on the developer lifetime. By virtue of the improved charging characteristics the developer will last longer. The charge controlling agents, when used as external additives, can be mounted or incorporated into the toner by several methods. The most commonly used method is by mixing the toner and charging agents in a high speed mixing device like a Henschel mixer. Preferably the charge controlling agents are mounted on the surface of the toner particles before any other optional surface or external additives like silicon and/or titanium dioxides are mixed with the toner particles.

It has also been noticed that the choice of other optional surface or external additives can be critical in obtaining a high transfer efficiency and good print quality when the toner has a circularity between 0.95 and 0.99. According to the present invention the best results were obtained by using at least one surface additive which has a primary particle size diameter greater than 20 nm, preferably greater than 50 nm. The maximum suitable particle size of the coarse additive is about 300 nm. The particle size diameter is preferably determined based on the specific surface area measured by BET. The surface additive can be of the fumed or colloidal silica type. Fumed metal oxides are prepared by high temperature hydrolysis of the corresponding vaporizable chlorides. Colloidal silica can be made by aggregation of silicate sols by applying the right process conditions. Also polymeric surface additives like polymethylmethacrylate can be used. Preferably the coarse additive is $SiO_2$-based. By using the right size external additive, the spacing properties of the rounded toner can be guaranteed so that embedding of the surface additive is avoided and good charging and flowing properties of the toner are preserved. Also the concentration of the coarse additive is important. The optimal concentration can be dependent on the particle size of the toner. For smaller toner particle sizes the concentration of the surface additive is preferably higher than for a larger toner particle size. The best results have been obtained when the concentration of the coarse additive (w/w %) lies between 0.3 and 3%, preferably between 0.5 and 2% and even more preferably between 0.5 and 1.25%. At a concentration of the surface additive below 0.3% by weight the spacing effect will be minimal, possibly resulting in embedding of the additive and thus poor developing ability, bad image quality and poor transfer efficiency. When the concentration of the coarse surface additive is >3% by weight the fusing and coalescence of the toner will be poor, thus resulting in a poor curing efficiency and a low gloss level of the toner layer.

Several ways can be used to mount the one or more surface additives onto the toner. The most commonly method is by mixing the toner and additives in a high speed mixing device like a Henschel mixer. When using different types of additives, e.g. a combination of a charge controlling agent and a surface additive, it can be beneficial to mount the additives in a specific order. Preferably the coarse surface additive is added as the last one.

Their exists several methods to produce round shaped toners. One can distinguish two main methods, although the present invention includes all suitable production methods within its scope:

- surface modification by preparing the toner by so called "chemical methods", and
- rounding, after or during the milling and classifying steps, melt extruded toner material. Preferably the rounding is done on a conventional extruded toner material and more preferably this is done by means of a heat treatment step after the classifying step. In this method the classified toner, already with or without some external additives, is dispersed in a hot air stream. By adjusting the air temperature and residence time one can set the desired circularity.

Within the class of chemically produced toners (hereinafter referred as CPT) also different methods can be used to produce rounded toner particles as is well known to the person skilled in the art. The most commonly used method is by making use of a suspension polymerization, e.g. with diene monomers and/or styrene monomers. A drawback of this method is that during the radical polymerization process the radical reactive bounds are used for making the polymer chains and are not available anymore for UV curing. Another chemical process is emulsion aggregation in which a polymer, a pigment and other toner ingredients dispersions are mixed together in an aqueous environment followed by a controlled aggregation. Still another chemical process is based on dissolving a polymer in a solvent which is suspended in an aqueous phase followed by a solvent removal. Compared to conventional prepared toners, the CPT toners offer less freedom in the choice of ingredients (due to the requirement of stability in water or solvent phase during polymerisation), and remaining chemical compounds such as solvent, monomers and/or dispersion agents can still be present in the final toner, which presence can disturb the charging properties of the toner and undesirably release these compounds during the fusing process.

The toner particles according to the present invention may comprise the radiation curable resin (radiation curable compounds or compositions), preferably the UV-curable resin, as sole toner resin, or the radiation curable resin(s) may be mixed with other (e.g. non-curable) toner resins. In the latter case all toner resins known in the art are useful for the production of toner particles according to this invention. The other toner resins mixed with the radiation curable resin(s) can be polycondensation polymers (e.g. polyesters, polyamides, co(polyester-polyamides), etc.), epoxy resins, addition polymers, or mixtures thereof in any proportions.

Although electron beam curable compounds or compositions can be used in making resins according to the present invention, the radiation curable groups of such resins are preferably curable or cured by UV-light.

Useful radiation curable polymeric compounds in toner particles for use in the present invention include UV curable solid epoxy resins with Tg≧40° C. as disclosed in EP 667, 381-B1. Other useful UV curable resins for incorporation in toner particles according to this invention are based on (meth) acryloyl-containing polyesters. The term polyester as used herein includes all polymers with a backbone structure based on a polycondensation of an alcohol, preferably one or more polyols having 2 to 5 hydroxyl groups and a carboxylic acid-containing compound. Examples of such UV curable resins are unsaturated polyesters based on terephthalic and/or isophthalic acid as the carboxylic acid-containing component, and on neopentyl glycol and/or trimethylolpropane as the polyol component and whereon afterwards an epoxy-acrylate such as glycidyl (meth)acrylate may be attached. These polymers are available for instance from Cytec Chemicals (Belgium) under the trade name Uvecoat. Another UV curable resin suitable for the present invention is a polyester-urethane acrylate polymer which may be obtained by the reaction of an hydroxyl-containing polyester, a polyisocyanate and a hydroxy-acrylate. Another binder resin system useful in the present invention is a mixture of an unsaturated polyester resin in which maleic acid or fumaric acid is incorporated and a polyurethane containing a vinyl ether, such as may be commercially available from DSM Resins (The Netherlands) under the trade name Uracross.

The above exemplary UV curable resins may be used alone or as a blend in a resin system in any proportions.

The reactivity of the binder resin may be expressed as the amount milli-equivalent of double bounds per gram (meq/g) of the radiation curable resin or polymer present in the dry toner particles of this invention. This number can be calculated from the resin composition or analytically determined by the use of e.g. NMR and/or IR techniques standard in the polymer art. Preferably the number of double bonds ranges from about 0.85 to about 2.5 meq/g and more preferably from about 0.1 to about 1.6 meq/g.

In an embodiment of the present invention, the glass transition temperature ($T_g$) of said binder polymers is above about 45° C. and the $T_g$ of the toner particles is higher than 40° C.

For the UV curing to proceed it may be necessary or preferred that one or more photoinitiators are present in the toner particles. Very useful photoinitiators in the context of this invention include, but are not limited to, compounds such as shown in the formulae I, II and III below, or mixtures of these compounds. Commercial photo-initiators are available from Ciba Geigy (Switzerland) under the trade name Irgacure.

Compound I

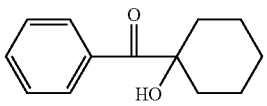

-continued

Compound II

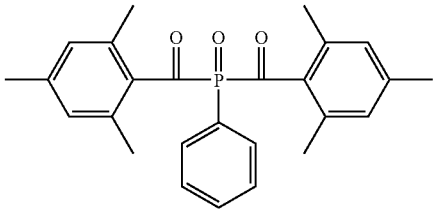

Compound III

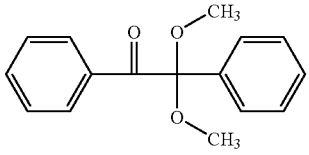

The photoinitiator is preferably incorporated in the toner particles together with the UV curable system in a concentration range of preferably 0.5-6% by weight. If the concentration of the photo-initiator exceeds about 6% by weight, the $T_g$ of the system can become too low.

Toner particles according to the present invention can be prepared by any method known in the art. Those toner particles can be prepared by melt kneading the toner ingredients (e.g. toner resin(s), charge control agent(s), pigment(s), etc.) and said radiation curable compounds. After the melt kneading step, the mixture is cooled and the solidified mass is pulverized and milled and the resulting particles classified by size. After the classifying step, a rounding step is performed and followed by the mounting of the optional surface additives.

Toner particles useful in this invention can have an average volume diameter (size) between about 3 and 20 μm. When the toner particles are intended for use in colour imaging, it is preferred that the volume average diameter is between 4 and 12 μm, most preferred between 5 and 10 μm. The particle size distribution of said toner particles can be of any type. It is however preferred to have an essentially (some negative or positive skewness can be tolerated, although a positive skewness, giving less smaller particles than an unskewed distribution, is preferred) Gaussian or normal particle size distribution, either by number or volume, with a coefficient of variability (standard deviation divided by the average) (v) smaller than about 0.5, more preferably of about 0.3.

Toner particles useful in this invention can comprise any normal toner ingredient e.g. colouring agents, pigments or dyes, both coloured and black, inorganic fillers, anti-slip agents, flowing agents, waxes, etc., in any standard proportion.

Toners for the production of colour images may contain one or more organic dyes/pigments of, for example, the group of phtalocyanine dyes, quinacidrone dyes, triaryl methane dyes, sulphur dyes, acridine dyes, azo dyes and fluoresceine dyes. Also $TiO_2$ or $BaSO_4$ can be used as a pigment to produce white toners. In order to obtain toner particles with sufficient optical density in the spectral absorption region of the colorant, the colorant is preferably present therein in an amount of at least about 1% by weight with respect to the total toner composition. To improve the distribution of the colorant in the toner resin, it may be beneficial to add a so called master batch of the colorant during the toner preparation in stead of adding the pure colorant. The master batch of the colorant is prepared by dispersing a relatively high concentration of the colorant, present as pure pigment or as press cake, preferably ranging from about 20% to about 50% by weight in a resin suitable for preferably homogeneous dispersion of said colorant. This resin does not need to be the same as the radiation curable polymer, e.g. a polyester, of the toner particles. The same master batch techniques can also be used for dispersing the charge control agent(s) and/or the photo initiators.

The toner particles of this invention can be used as mono-component developers, both as a magnetic and as a non-magnetic mono-component developer. The toner particles of this invention can also be used in a multi-component developer wherein both magnetic carrier particles and toner particles are present or in a trickle type development where both toner and carrier are added to the developer system with simultaneous removal of a part of the developer mixture. The toner particles of this invention can be negatively charged as well as positively charged.

Carrier particles for the developer composition can be either magnetic or non-magnetic. Preferably, the carrier particles are magnetic particles. Suitable magnetic carrier particles have a core of, for example, iron, steel, nickel, magnetite, $\gamma$-$Fe_2O_3$, or certain ferrites such as for example CuZn and environmental friendly ferrites with Mn, MnMg, MnMgSr, LiMgCa and MnMgSn. These carrier particles can be of various shapes, for example, irregular or regular shape. Generally these carrier particles have a median particle size between about 30 μm and about 65 μm. Exemplary non-magnetic carrier particles include glass, non-magnetic metal, polymer and ceramic material.

Non-magnetic and magnetic carrier particles can have similar particle size. Preferably the carrier core particles are coated or surface treated, in a manner well known to the skilled person, with diverse organic or inorganic materials or resins in a concentration of about 0.4% to about 2.5% by weight to obtain, for example, desirable electrical, tribo-electrical and/or mechanical properties.

In the two-component developer composition according to the present invention, the amount of UV curable toner particles can be, for example, between about 3 and about 12 weight % (relative to the amount of developer).

Tribo-electric charging of the toner particles proceeds in so-called two component developer mixtures by means of the carrier particles. Charging of individual toner particles through triboelectricity is a statistical process, which will result in a broad distribution of charge over the number of toner particles in the developer. The charge can be measured e.g. with a q/d meter available from Dr R. Epping PES Laboratorium D 8056 Neufahrn, Germany. The apparatus measures the distribution of the toner charge (in fC) with respect to a measured toner diameter (diameter in 10 μm). The measurement results are expressed as a percentage particle frequency of the same q/d ratio (y-axis) on q/d ratio expressed as fC/10 μm (in x-axis). If a relative large amount of toner particles have a charge too low for providing a sufficiently strong coulomb attraction, the development of such kind of developer results in undesirable image-background fog. To avoid such fog in the printed image, the distribution of charge/diameter (q/d) of the toner particles needs to range from an absolute value of 3 to 15 fC/10 μm, preferably 4-12 fC/10 μm and more preferably 5-11 fC/10 μm.

The substrate to be printed with the toner particles, preferably the UV curable toner particles of this invention, can be paper, plastic or metal foils, or combinations of them in, for example, different thicknesses.

Suitable paper substrates for printing can have a smooth surface, may have a glossy finish, can be coloured or uncoloured, and can weigh for example from 10 to 300 mg/cm$^2$.

Suitable multilevel (multilayer) substrate materials for printing can be made out of two or more foil layers, e.g. paper, plastics and/or metal foils.

Examples of metal foils as substrates for printing are foils from iron, steel, and copper and preferentially from aluminium and its alloys.

Suitable plastics substrate materials for printing include e.g. polyvinyl chloride (PVC), polyvinylidene chloride (PVDC), polyester, polycarbonates, polyvinyl acetate, and polyolefins, particularly polyethylenes (PE) like polyethylene of high density (HDPE), polyethylene of middle density (MDPE), linear polyethylene-middle density (LMDPE), polyethylene low-density (LDPE) and linear polyethylene low-close (LLDPE).

The thickness of the substrate for printing can range from e.g. about 5 μm until about 1,000 μm, preferably from about 15 μm till about 200 μm. For papers, coated on one side with plastic or metal foil, the thickness can vary from about 5 till about 500 μm, preferably about 30 to about 300 μm. The thickness of plastic foils can range from about 8 to about 1,000 μm thick. Metal foils can exhibit a thickness from about 5 to about 300 μm.

The substrate for printing can be fed to the printing apparatus by means of a web, preferably for thin substrates in order to avoid jams, or by means of sheets.

The present invention also includes a method for forming a toner image on a substrate comprising the steps of:

i) image-wise depositing coloured rounded toner particles comprising a radiation curable resin as described in any of the above embodiments on said substrate, ii) fusing said toner particles on said substrate, and iii) radiation curing said fused toner particles.

In a preferred embodiment of this method, the image wise deposition on said substrate is done by image wise developing a latent image on a photoconductor and transferring said developed toner image by an intermediate means or directly to the substrate.

The radiation curing can proceed in line or off line. Inline curing means that the curing proceeds in the fusing station of the apparatus itself (e.g. with the use of UV-light transparent fuser rollers) or in a station immediately adjacent to said fusing station.

The radiation curing can also proceed off-line in a separate apparatus. In this case the fused toner images can be fed immediately to this separate curing apparatus without first stacking or rewinding the substrate. It is also possible to rewind or stack first the substrate before feeding it again to the curing station. It can be beneficial that the fused toner is reheated again so that the toner layer becomes again in a molten state before the radiation (UV) curing proceeds.

Preferably said radiation curing proceeds at a temperature that preferably is at most 150° C. Therefore it is preferred to use toner particles comprising a radiation curable compound having a $T_g \geqq 45°$ C., that has a melt viscosity at 120° C. between about 50 and about 3,000 Pa·s, preferably between about 100 and about 2,000 Pa·s.

The present invention further includes an apparatus for forming a toner image on a substrate comprising:

i) means for image-wise depositing toner particles comprising a radiation curable resin as described in any of the above embodiments on said substrate, ii) means for fusing said toner particles on said substrate, and iii) means for off-line or in-line radiation curing said fused toner particles.

In a preferred apparatus according to this invention the substrate is fed from a web.

Said means for fusing said toner particles to the substrate can be any means known in the art, e.g. can be contact means (e.g. hot-pressure rollers) or non-contact means. Non-contact fusing means according to this invention can include a variety of embodiments such as, but not limited to: (1) an oven heating process in which heat is applied to the toner image by hot air over a wide portion of the support sheet, (2) a radiant heating process in which heat is supplied by infrared and/or visible light absorbed in the toner, the light source being e.g. an infrared lamp or flash lamp. According to a particular embodiment of "non-contact" fusing, the heat reaches the non-fixed toner image through its substrate by contacting the support at its side remote from the toner image with a hot body, e.g., a hot metallic roller. In the present invention, non-contact fusing by radiant heat, e.g., infrared radiation (IR-radiation), is preferred.

In a contact fusing process, the non-fixed toner images on the substrate are contacted directly with a heated body, i.e. a so-called fusing member, such as fusing roller or a fusing belt. Usually a substrate carrying non-fixed toner images is conveyed through a nip formed by establishing a pressure contact between said fusing member and a backing member, such as a roller. To obtain high quality images, it is recommended to use hot roller systems with a low amount of release agents.

In an apparatus according to the present invention it is preferred to use toner particles comprising a UV-curable resin and thus the means for radiation curing the toner particles comprise or are means for UV-curing (i.e. UV-light emitters as e.g. UV lamps). In an apparatus according to the present invention, it is preferred that the radiation curing proceeds inline. Therefore it is preferred that said means for fusing said toner images emit infrared radiation (are infra-red radiators) and said means for UV curing (e.g. one or more UV emitting lamps) are installed immediately after said fusing means so that the UV curing proceeds on the still molten toner image. Different techniques exist for activating the UV lamps, such as UV lamps powered by microwave technology or arc lamps. Different types of UV lamps can be used and the choice of the type of UV lamp that will be used, i.e. V, D, or F bulb, will depend on the toner formulation and on the type of photo initiator that is used. A proper match between the emission spectrum of the UV lamp and the absorption spectra of the used photo initiator is recommended to obtain an efficient curing. A combination of infra-red radiators (the means for fusing the toner particles) and UV emitting lamps (the means for radiation curing) in a single station (a fixing/curing station), so that the fusing and the radiation curing proceed simultaneously, is also a desirable design feature of an apparatus according to this invention. The apparatus according to the present invention can comprise if so desired, more than one fixing/curing station. The UV emitting means are preferably UV radiators with a UV power between about 25 W/cm and about 250 W/cm. Depending on the curing speed and the chosen UV power will this result in a UV dose of 0 to about 5 J/cm2.

The means for image-wise depositing toner particles can, in an apparatus according to this invention, also be direct electrostatic printing means (DEP), wherein charged toner particles are attracted to the substrate by an electrical field and the toner flow modulated by a print-head structure comprising printing apertures and control electrodes.

Said means for image-wise depositing toner particles can also be toner depositing means wherein first a latent image is formed. In such an apparatus, within the scope of the present invention, said means for image-wise depositing toner particles comprise:

i) means for producing a latent image on a latent image bearing member, ii) means for developing said latent image by the deposition of said toner particles, forming a developed image, and iii) means for transferring said developed image on said substrate.

Said latent image may be a magnetic latent image that is developed by magnetic toner particles (magnetography) or, preferably, an electrostatic latent image. Such an electrostatic latent image is preferably an electrophotographic latent image and the means for producing a latent image are in this invention preferably light emitting means, e.g., light emitting diodes or lasers and said latent image bearing member comprises preferably a photoconductor.

The following examples are provided for a better understanding of the invention and for illustrative purposes only, and should in no way be construed as limiting the scope of this invention.

Test Methods

Charge Ability-Developing Ability Performance

A print test is carried out on a Xeikon 5000 print engine at a speed of 16 cm/s. over 50Ka3 with a cyan developer. The target optical density was 1.4. The following sequence was printed:

A: 20Ka3 was printed with a toner throughput of 50 mg/s.

B: 10Ka3 was printed with a toner throughput of 5 mg/s

C: 5Ka3 was printed with a toner throughput of 50 mg/s

D: 5Ka3 was printed with a toner throughput of 300 mg/s

Changes in the developer's charge ability and developing ability can result as a consequence in a change of amount of toner that is extracted and replenished per unit of time in a situation of continued printing. The toner throughput after a long runs in regimes A, B, C or D typically affects the density at fixed development settings to a certain degree because of known effects of additive burial, etc. as discussed in U.S. Pat. No. 6,358,658-B1. For stable printing it is required to adapt development settings (e.g. field strength) or to adjust toner density to the target level. Too low density requires an increase of the development field and a too high density requires a decrease in development field. In a reversal development process as used in the Xeikon 5000 print engine, the increase in the development field is induced by an increase of the exposure intensity and vice versa.

Evaluation

1=excellent performance: almost no difference in exposure intensity between A, B and D.

3=good performance: small differences in exposure intensity development potential between A, B and D.

5=acceptable performance: acceptable differences in exposure intensity between A, B and D.

7=bad performance: too large differences in exposure intensity between A, B and D.

10=unacceptable performance: unacceptable differences in exposure intensity between A, B and D—density of 1.4 could not be reach after printing B.

Curing Performance

With a cotton path 4-4931 from AB Dick sucked with MEK (methyl ethyl ketone) the fused and cured toner images were rubbed with a pressure between 100 and 300 g/cm2. One count is equal to an up and down rub. The image that is rubbed has an applied mass of 1 mg/cm2.

The rubs are counted till the substrate becomes visible. The number of rubs is a measure for the solvent resistance of the toner images The toners are deposited on an uncoated 135 gsm paper (Modo Diane data copy option from M-reel) and fused for 7 minutes at 135° C. in an oven and afterwards cured with 190 W/cm at a speed of 12 cm/s. Prior to curing the samples were reheated to a temperature of 80° C. to 110° C.

Evaluation

1=excellent curing (ratio of number of rubs of formula with and without charging agents >0.95).

3=good curing (ratio of number of rubs of formula with and without charging agents >0.85).

5=acceptable curing (ratio of rubs of formula with and without charging agents >0.75).

7=bad curing (ratio of rubs of formula with and without charging agents <0.70).

10=unacceptable curing (ratio of number of rubs of formula with and without charging agents <0.60).

Hollow Characters

The level of hollow characters was observed visually. A red and green patch of 2 mm wide and 50 mm length was printing along the process direction. The red was printed as 100% yellow covered by 100% magenta and the green as 100% yellow covered by 100% cyan.

Evaluation:

1=excellent: no yellow could be seen.

3=good: only a very small part of yellow could be seen.

5=acceptable: only small part of yellow could be seen.

7=bad: a large part of yellow could be seen.

10=unacceptable: the patch is observed as yellow.

Image Quality

The image quality was observed visually by evaluating the noise level and the transition effects (transition from white to a light colour and vice versa). Evaluation:

1=excellent: no transition effects seen.

3=good: the level of transition effects is very small and the image noise is only noticeable is small part of the image.

5=acceptable: the level of transition effects is noticeable but not disturbing.

7=bad: transition effects can be noticed very well independent of the image density.

10=unacceptable: the transition effects and the noise in the image are very well noticeable.

Circularity

The circularity is a parameter which indicates the roundness of a particle. When the circularity is 1 the particle is a perfect sphere.

The circularity of the toner is a value obtained by optically detecting toner particles, and is the circumference of a circle with the same projected area as that of the actual toner particle divided by the circumference of the actual toner particle. Specifically, the average circularity of the toner is measured using a flow particle image analyser of the type FPIA-2000 or FPIA-3000 manufactured by Sysmex Corp. In this device, a sample is taken from a diluted suspension of particles. This suspension is passed through a measurement cell, where the sheath flow ensures that all particles of the sample lie in the same focusing plane. The images of the particles are captured using stroboscopic illumination and a CCD camera. The photographed particle image is subjected to a two dimensional image processing, and an equivalent circle diameter and circularity are calculated from the projected area and peripheral length.

Particle Size of Toner

The $dv_{50}$ is the particle size where 50% in volume of the particles have a size which is smaller than the $dv_{50}$. This size is measured with a Coulter Counter (registered trade mark) Multisizer particle size analyzer operating according to the principles of electrolyte displacement in narrow aperture and marketed by Coulter Electronics Corp. Northwell Drive, Lutton Bedfordshire, United Kingdom. In said apparatus particles suspended in an electrolyte (e.g. aqueous sodium chloride) are forced through a small aperture, across which an electric current path has been established. The particles passing one-by-one each displace electrolyte in the aperture producing a pulse equal the displacement volume of electrolyte. Thus particle volume response is the base for said measurement.

EXAMPLES

The toners were prepared by melt blending for 30 minutes in a laboratory kneader at 110° C. the ingredients, together with 3% by weight of a phtalocyanine blue pigment, as mentioned in table 1. After cooling, the solidified mass was pulverized and milled using a Alpine fliessbettgegenstrahlmuhle 100AFG (trade name) and further classified using a multiplex zig-zag classifier type 100MZR (trade name) to obtain a toner with a $dv_{50}$ between 7 and 9 μm.

Those toners were subjected to a heat treatment in order to obtain a rounded toner with circularities as mentioned in table 1.

After the heat treatment, the additives were added by a Henschel mixing device. When the charge controlling agent was used as an external additive, is was mounted first followed by surface additives.

Developers

Developers were prepared by mixing 5 g of said toner particles of T1 to T5 together with 100 g of a coated silicone MnMgSr ferrite carrier with a $dv_{50}$ of 45 μm.

From toners T6 to T15 developers were prepared by mixing 5 g of said toner particles together with 100 g of a coated silicone CuZn ferrite carrier with a $dv_{50}$ of 45 to 55 μm.

Images were developed with an applied mass of 1 mg/cm2 on uncoated 135 gsm paper and fused at 135° C. for 7 minutes in an oven to check the curing performance.

With all the developers a lifetime test was performed in a Xeikon 5000 engine to check the image quality, hollow character level, charge ability and developing ability.

The results are summarized in table 1.

From table 1 it can be seen that the level of hollow characters can greatly be improved by rounding the toner (compare the rounded toners T1 to T8 with non rounded toner T11-T12). When the toner is too round (T10), the hollow character level and image quality are very good but the chargeability is very bad. From the unsufficiently rounded toners T11 and T12 we learn that the image quality is inferior to that of suitably rounded toners (T1 to T8). When the concentration of the surface additive is high (T12) the curing and image quality becomes worse. From the curing results we can clearly see that the use of charging agent in a concentration of 2% by weight (see toner T9) results in a bad curing degree compared with toner T1 having a total charging agents concentration of 0.9% by weight. Toners T2 to T8 with the charging agent at the surface of the toner particles in a concentration between 0.1 and 0.5% by weight exhibit both a good curing capability and a good chargeability.

FIG. 1 shows an example of a type of printer with which toners according to the present invention may be used. Referring to FIG. 1, there is shown a duplex electrostatographic printer having a supply station 13 in which a roll 14 of web material 12 is housed, in sufficient quantity to print, say, up to 5,000 images. The present invention is not limited to web printers and can equally well be used for sheet printers. The web 12 is conveyed into a tower-like printer housing 44 including at least one column 46 housing four similar printing stations A to D. In addition, a further station E can be provided in order to optionally print an additional colour, for example a specially customised colour, for example white.

The printing stations A-E each comprise a cylindrical drum having a photoconductive outer surface. Circumferentially arranged around the photoconductive drum there is a main corotron or scorotron charging device capable of uniformly charging the drum surface, for example to a potential of about −600V, an exposure station which may, for example, be in the form of a scanning laser beam or an LED array, which will image-wise and line-wise expose the photoconductive drum surface causing the charge on the latter to be selectively reduced, for example to a potential of about −250V, leaving an image-wise distribution of electric charge to remain on the drum surface. This so-called "latent image" is rendered visible by a developing station which by means known in the art will bring a developer in accordance with any of the embodiments of the present invention in contact with the photoconductive drum surface. The developing station includes a developer drum which is adjustably mounted, enabling it to be moved radially towards or away from the photoconductive drum. The developer contains (i) toner particles according to

TABLE 1

| toner | | polymer | | initiator BAPO type | AHK type | charging agents (CCA) core | charging agents (CCA) shell | coarse surface additive type | coarse surface additive conc | circularity | hollow characters | image quality | charge developability | curing |
|---|---|---|---|---|---|---|---|---|---|---|---|---|---|---|
| T1 | inv | UVP1 | UVP2 | 1 | — | 0.9 | 0 | TVS2 | 0.75 | 0.972 | 2 | 4 | 5 | 5 |
| T2 | inv | UVP1 | UVP2 | 1 | — | 0 | 0.1 | TVS1 | 0.8 | 0.97 | 4 | 3 | 4 | 2 |
| T3 | inv | UVP1 | UVP2 | 1 | — | 0 | 0.1 | TVS2 | 0.75 | 0.97 | 2 | 2 | 3 | 2 |
| T4 | inv | UVP1 | UVP2 | 1 | — | 0 | 0.2 | TVS2 | 0.75 | 0.97 | 2 | 2 | 2 | 2 |
| T5 | inv | UVP1 | UVP2 | 3 | — | 0 | 0.2 | TVS2 | 0.75 | 0.963 | 3 | 3 | 2 | 3 |
| T6 | inv | UVP1 | UVP2 | — | 1.5 | 0 | 0.15 | TVS2 | 0.75 | 0.978 | 4 | 4 | 3 | 3 |
| T7 | inv | UVP1 | — | 3 | — | 0 | 0.15 | TVS2 | 0.75 | 0.984 | 4 | 3 | 3 | 3 |
| T8 | inv | UVP1 | — | — | 1.5 | 0 | 0.15 | TVS2 | 0.75 | 0.959 | 3 | 3 | 3 | 2 |
| T9 | comp | UVP1 | UVP2 | 1 | — | 2 | 0 | TVS1 | 0.8 | 0.967 | 5 | 4 | 3 | 8 |
| T10 | comp | UVP1 | UVP2 | 1 | — | 0 | 0 | TVS2 | 0.75 | 0.992 | 1 | 3 | 9 | 4 |
| T11 | comp | UVP1 | UVP2 | 1 | — | 0 | 0 | TVS2 | 0.75 | 0.94 | 7 | 6 | 5 | 3 |
| T12 | comp | UVP1 | UVP2 | 1 | — | 0 | 0 | TVS2 | 4 | 0.935 | 5 | 7 | 4 | 6 |

| | |
|---|---|
| UVP1 | (meth) acryloyl containing polyester unsaturated polyester of terefphtalic acid and neopentyl glycol |
| UVP2 | polyesterurethane (meth)acrylate resin (unsaturated urethane acrylic adduct) |
| CCA | zinc salicylate compound |
| TVS 1 | hydrofhobic colloidal silica of 150 nm |
| TVS 2 | hydrofobic fumed silica with particle size of 50 nm |

any of the embodiments of the present invention including optionally a dye or pigment of the appropriate colour, and (ii) carrier particles charging the toner particles by frictional contact therewith. Negatively charged toner particles, triboelectrically charged to a level of, for example 9 μC/g, are attracted to the photo-exposed areas on the photoconductive drum surface by the electric field between these areas and the negatively electrically biased developer so that the latent image becomes visible. After development, the toner image adhering to the photoconductive drum surface is transferred to the moving web 12 by a transfer corona device. After passing the first printing station A, as described above, the web passes successively to printing stations B, C, D, and optionally E where images in other colours are transferred to the web.

The printing stations A to E are mounted in a substantially vertical configuration resulting in a reduced footprint of the printer and additionally making servicing easier. The column 46 may be mounted against vibrations by means of a platform 48 resting on springs 50, 51. In the embodiment shown in FIG. 1 two columns 46 and 46' are provided each housing printing stations A to E and A' to E' respectively. For the sake of clarity, the columns 46 and 46' are not fully shown in figure. The columns 46 and 46' are mounted closely together so that the web 12 travels in a generally vertical path defined by the facing surfaces of imaging station drums 24, 24'. This arrangement is such that each imaging station drum acts as the guide roller for each adjacent drum by defining the wrapping angle. Intermediate image-fixing stations are optional. However, by avoiding the use of intermediate fixing, front-to-back registration of the printed images is made easier. Although in FIG. 1 the columns 46 and 46' are shown as being mounted on a common platform 48, it is possible in an alternative embodiment for the columns 46 and 46' to be separately mounted, such as for example being mounted on horizontally disposed rails so that the columns may be moved away from each other for servicing purposes and also so that the working distance between the columns may be adjusted.

Further details of the items described above as well as other printer designs can be found in U.S. Pat. No. 5,455,668 which is incorporated herein by reference in its entirety.

After leaving the final printing station E, the image on the web is fixed by means of the image-fixing station 16. This can be a non-contact or contact fixing means. An optional cooling zone may be provided. The web 12 is conveyed through the printer by two drive rollers 22*a*, 22*b* one positioned between the supply station 13 and the first printing station A and the second positioned between the image-fixing station 16 and the cutting station 20. The drive rollers 22*a*, 22*b* are driven by controllable motors, 23*a*, 23*b*. In addition the toner is cured by means of a radiation curing station 18. This can be in-line as shown in FIG. 1 or it can be done off-line. The web is optionally fed to a cutting station 20 (schematically represented) and a stacker 52 if desired or the output can be in web-form.

Figure 2:
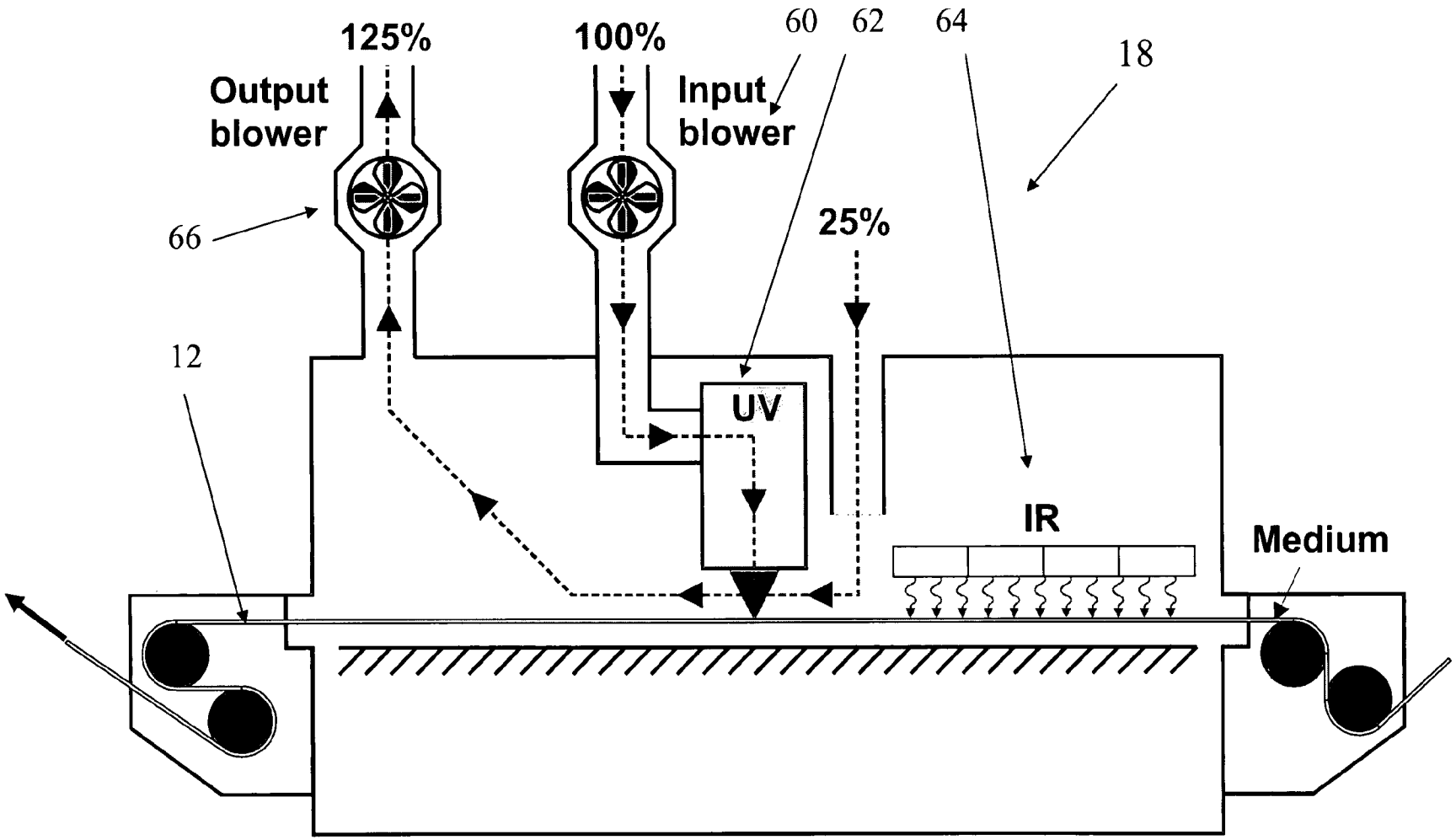
FIG. 2 shows an exemplary curing station usable off-line.

FIG. 2 shows a curing station 18 as an embodiment of the present invention that can be used off-line for example. The web material 12 with the fused or fixed images thereon is fed to a infrared heating device 64. During this step the image-wise applied toner image that has been transferred to the substrate can be heated so that that toner comes into a plastic or molten state before the web enters the radiation curing device 62 such as a UV curing source. Air cooling may be provided by input and output cooling fans or blowers 60, 62 whereby for example a proportion, e.g. 25% of the air flow may be sucked from the environment of the curing device 62. The web is optionally fed to a cutting station (not shown) and a stacker if desired (not shown).

The invention claimed is:

1. Dry toner particles comprising:

at least a radiation curable resin;

a colouring agent; and at least one charge controlling agent, wherein said dry toner particles are radiation curable; said toner particles have a circularity between 0.95-0.99; and the concentration of the charge controlling agent in said dry toner particles is between 0.025% and 1.0% by weight.

2. Dry toner particles according to claim 1, wherein said at least one charge controlling agent is at the surface of the toner particle.

3. Dry toner particles according to claim 1, wherein the concentration of the charge controlling agent is between 0.1% and 0.3% by weight.

4. Dry toner particles according to claim 1, further comprising at least one surface additive.

5. Dry toner particles according to claim 1, wherein the viscosity of the toner particles is between 50 and 5,000 Pa·s at 120° C.

6. Dry toner particles according to claim 1, wherein the radiation curable resin comprises a UV curable polyester resin.

7. Dry toner particles according to claim 1, wherein the radiation curable resin comprises a blend of:

(meth)acryloyl containing polyester, and a polyester-urethane (meth)acrylate resin.

8. Dry toner particles according to claim 1, further comprising a non-curable resin.

9. A dry electrostatographic developer composition comprising carrier particles and toner particles, wherein said toner particles are dry toner particles comprising at least a radiation curable resin, a colouring agent and at least one charge controlling agent, wherein said dry toner particles are radiation curable; said toner particles have a circularity between 0.95-0.99; and the concentration of the charge controlling agent in said dry toner particles being between 0.025% and 1.0% by weight.

10. Dry toner particles according to claim 1, wherein said toner has a glass transition temperature higher than 40° C.

11. Dry toner particles according to claim 1, wherein said radiation curable resin has a glass transition temperature higher than 45° C.

12. A dry electrostatographic developer composition comprising carrier particles and toner particles, wherein:

said toner particles are dry toner particles comprising at least a radiation curable resin, a colouring agent and at least one charge controlling agent, wherein said dry toner particles are radiation curable; said toner particles have a circularity between 0.95-0.99; and the concentration of the charge controlling agent in said dry toner particles being between 0.025% and 1.0% by weight;

said carrier particles have a volume average particle size of between 30 to 65 μm; and/or said carrier particles comprise a core particle coated with a resin in an amount of 0.4 to 2.5% by weight; and/or an absolute charge expressed as fC/10 μm (q/d) is between 3 and 15 fC/10 μm.

13. A method of fusing and curing dry toner particles, wherein said dry toner particles comprise at least a radiation curable resin, a colouring agent and at least one charge controlling agent, wherein said dry toner particles are radiation curable, said toner particles have a circularity between 0.95-0.99, and the concentration of the charge controlling agent in said dry toner particles being between 0.025% and 1.0% by weight, comprising the steps of:

image wise depositing said toner particles on a substrate;

fusing said toner particles onto said substrate; and finally, curing the fused toner particles by means of radiation.

14. A method of fusing and curing dry toner particles, wherein said dry toner particles comprise at least a radiation curable resin, a colouring agent, one or more photoinitiators, and at least one charge controlling agent, wherein said dry toner particles are radiation curable, said toner particles have a circularity between 0.95-0.99, and the concentration of the charge controlling agent in said dry toner particles being between 0.025% and 1.0% by weight, comprising the steps of:

image wise depositing said toner particles on a substrate;

fusing said toner particles onto said substrate; and finally, curing the fused toner particles by means of UV light.

15. An apparatus for forming a toner on a substrate comprising:

means for supplying dry toner particles, said dry toner particles comprising at least a radiation curable resin, a colouring agent and at least one charge controlling agent, wherein said dry toner particles are radiation curable, said toner particles have a circularity between 0.95-0.99, and the concentration of the charge controlling agent in said dry toner particles being between 0.025% and 1.0% by weight, means for image-wise depositing said dry toner particles on said substrate, means for fusing said toner particles on said substrate, and means for off-line or in-line radiation curing said fused toner particles.

16. A substrate marked or printed with a toner, said toner being dry toner particles comprising at least a radiation curable resin, a colouring agent and at least one charge controlling agent, wherein said dry toner particles are radiation curable, said toner particles have a circularity between 0.95-0.99, and the concentration of the charge controlling agent in said dry toner particles is between 0.025% and 1.0% by weight.

* * * * *